US010255866B2

(12) United States Patent
Yu et al.

(10) Patent No.: US 10,255,866 B2
(45) Date of Patent: Apr. 9, 2019

(54) DRIVING CIRCUIT, DRIVING METHOD THEREOF AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Jie Yu, Beijing (CN); Yangbing Yu, Beijing (CN); Pai Sun, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/544,912

(22) PCT Filed: Feb. 3, 2017

(86) PCT No.: PCT/CN2017/072808

§ 371 (c)(1),
(2) Date: Jul. 20, 2017

(87) PCT Pub. No.: WO2017/193648

PCT Pub. Date: Nov. 16, 2017

(65) Prior Publication Data

US 2018/0226033 A1 Aug. 9, 2018

(30) Foreign Application Priority Data

May 13, 2016 (CN) ..... 2016 1 0320021

(51) Int. Cl.

| | |
|---|---|
| ***G09G 3/36*** | (2006.01) |
| ***G09G 3/20*** | (2006.01) |
| ***G09G 5/00*** | (2006.01) |

(52) U.S. Cl.
CPC ..... *G09G 3/3611* (2013.01); *G09G 3/20* (2013.01); *G09G 5/005* (2013.01);
(Continued)

(58) Field of Classification Search
CPC . G09G 3/3685; G09G 3/3688; G09G 2310/08
(Continued)

(56) References Cited

U.S. PATENT DOCUMENTS

| | | | |
|---|---|---|---|
| 9,318,063 | B2 | 4/2016 | Kim |
| 2008/0198107 | A1 | 8/2008 | Park et al. |

(Continued)

FOREIGN PATENT DOCUMENTS

| | | | |
|---|---|---|---|
| CN | 1450520 | A | 10/2003 |
| CN | 1655214 | A | 8/2005 |

(Continued)

OTHER PUBLICATIONS

First Office Action for Chinese Patent Application No. 201610320021.0 dated Nov. 3, 2017.

(Continued)

*Primary Examiner* — Roy P Rabindranath
(74) *Attorney, Agent, or Firm* — Calfee, Halter & Griswold LLP

(57) ABSTRACT

A driving circuit, a driving method thereof and a display device including the driving circuit are disclosed. The driving circuit includes a driving unit and a storage unit coupled to the driving unit. The storage unit caches image data. The driving unit receives an original signal of an image of a current frame, converts the original signal of the image of the current frame into image data of the current frame, and compares the image data of the current frame with image data of a previous frame cached in the storage unit. When the image data of the current frame is consistent with the image data of the previous frame, a display panel displays an image (Continued)

of the previous frame, and when the image data of the current frame is not consistent with the image data of the previous frame, the display panel displays an image of the current frame.

11 Claims, 4 Drawing Sheets

(52) U.S. Cl.
CPC ..... *G09G 2310/0264* (2013.01); *G09G 2320/103* (2013.01); *G09G 2330/021* (2013.01); *G09G 2380/10* (2013.01)

(58) Field of Classification Search
USPC ..... 345/99–100
See application file for complete search history.

(56) References Cited

U.S. PATENT DOCUMENTS

| | | | | |
|---|---|---|---|---|
| 2012/0162159 | A1* | 6/2012 | Kim | G09G 3/3233 345/204 |
| 2013/0215096 | A1 | 8/2013 | Kim | |
| 2014/0003595 | A1 | 1/2014 | Beerse et al. | |
| 2017/0294169 | A1* | 10/2017 | Lee | G09G 3/3688 |

FOREIGN PATENT DOCUMENTS

| | | | |
|---|---|---|---|
| CN | 1697011 | A | 11/2005 |
| CN | 1787060 | A | 6/2006 |
| CN | 202275592 | U | 6/2012 |
| CN | 103310722 | A | 9/2013 |
| CN | 103310760 | A | 9/2013 |
| CN | 104079655 | A | 10/2014 |
| CN | 104655268 | A | 5/2015 |
| CN | 104849330 | A | 8/2015 |
| CN | 105137771 | A | 12/2015 |
| CN | 106027124 | A | 10/2016 |
| EP | 2693425 | A1 | 2/2014 |

OTHER PUBLICATIONS

Search Report for International Patent Application No. PCT/CN2017/072952 dated May 3, 2017.

* cited by examiner

DRIVING CIRCUIT, DRIVING METHOD THEREOF AND DISPLAY DEVICE

CROSS-REFERENCE TO RELATED APPLICATIONS

This application is based upon International Application No. PCT/CN2017/072808, filed on Feb. 3, 2017, which is based upon and claims priority of Chinese Patent Application No. 201610320021.0 filed on May 13, 2016, which is hereby incorporated by reference in its entirety as part of this application.

TECHNICAL FIELD

The present disclosure relates to the field of display technology, and more particularly to a driving circuit, driving method thereof and a display device including the driving circuit.

BACKGROUND

Nowadays, with the development of vehicle on-board display technology, products such as central control navigation display, LCD dashboard display, rearview mirror display and the like have been presented. With the continuous innovation of technology, irregularly shaped display devices, curve-surface display devices are also used in the field of vehicle on-board display. However, products used in the field of vehicle on-board displays require a higher capacity to prevent electrostatic discharge.

In the related art, when electrostatic discharge test is performed, a timing controller chip converts a received low voltage differential signal (LVDS) directly into a miniature LVDS (Mini-LVDS), and then outputs the Mini-LVDS to a display panel. The display panel displays an image according to the Mini-LVDS.

It should be noted that, information disclosed in the above background portion is provided only for better understanding of the background of the present disclosure, and thus it may contain information that does not form the prior art known by those skilled in the art.

SUMMARY

The present disclosure provides a driving circuit and a driving method thereof, and a display device including the driving circuit.

According to one aspect of the present disclosure, there is provided a driving circuit, including a driving unit and a storage unit coupled to the driving unit. The storage unit is configured to cache image data. The driving unit is configured to receive an original signal of an image of a current frame, convert the original signal of the image of the current frame into image data of the current frame, and compare the image data of the current frame with image data of a previous frame cached in the storage unit. When the image data of the current frame is consistent with the image data of the previous frame, the driving unit drives a display panel to display an image of the previous frame, and when the image data of the current frame is not consistent with the image data of the previous frame, the driving unit drives the display panel to display an image of the current frame.

According to another aspect of the present disclosure, there is provided a display device, including a display panel and the driving circuit according to the embodiments of the present disclosure.

According to another aspect of the present disclosure, there is provided a driving method of a driving circuit, the driving circuit including a driving unit and a storage unit coupled to the driving unit, wherein the driving method includes: receiving an original signal of an image of a current frame, and converting the original signal of the image of the current frame to image data of the current frame; comparing the image data of the current frame with image data of a previous frame cached in the storage unit; when the image data of the current frame is consistent with the image data of the previous frame, driving, by the driving unit, a display panel to display an image of the previous frame; and when the image data of the current frame is not consistent with the image data of the previous frame, driving, by the driving unit, the display panel to display an image of the current frame.

It is to be understood that both the foregoing general description and the following detailed description are exemplary and explanatory only and are not restrictive of the present disclosure, as claimed.

This section provides a summary of various implementations or examples of the technology described in the disclosure, and is not a comprehensive disclosure of the full scope or all features of the disclosed technology.

BRIEF DESCRIPTION OF THE DRAWINGS

The accompanying drawings are intended to provide further understanding of the present disclosure and constitute a part of the specification, together with the following detailed description, serve as explaining the present disclosure, but are not to be construed as limiting the present disclosure. In the drawings.

DETAILED DESCRIPTION

In order to provide a better understanding of the technical solution of the present disclosure to those skilled in the art, the driving circuit, the driving method thereof and the display device including the driving circuit will be described in detail with reference to the accompanying drawings.

Figure 1:
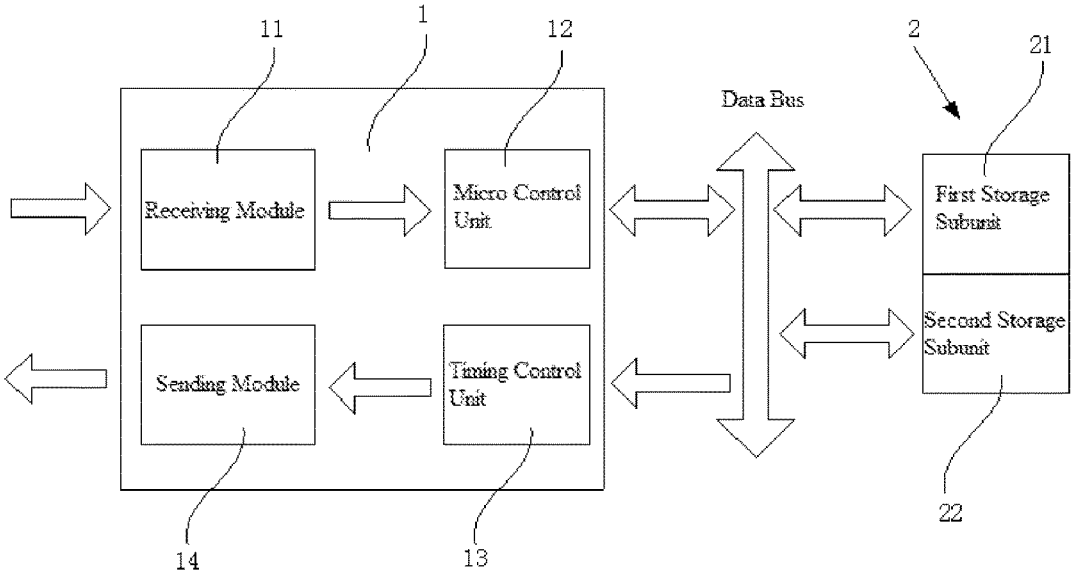
FIG. 1 is a schematic block diagram of a driving circuit according to an embodiment of the present disclosure.

FIG. 1 is a schematic block diagram of a driving circuit according to an embodiment of the present disclosure.

As shown in FIG. 1, the driving circuit according to the embodiment of the present disclosure may include a driving unit 1 and a storage unit 2 coupled to the driving unit 1. The storage unit 2 may be configured to cache image data. The driving unit 1 may be configured to receive an original signal of an image of a current frame (as shown by the arrow at left upper side in the figure), convert the original signal of the image of the current frame into image data of the current frame, and compare the image data of the current frame with a previous image data cached in the storage unit 2. When the image data of the current frame is consistent with the image data of the previous frame, the driving unit 1 drives the display panel (not shown in the figure) to display the image of the previous frame. When the image data of the current frame is not consistent with the image data of the previous frame, the driving unit 1 drives the display panel to display the image of the current frame.

According to the embodiment of the present disclosure, as shown in FIG. 1, the storage unit 2 may include a first storage subunit 21 and a second storage subunit 22. The driving unit 1 compares the image data of the current frame with the image data of the previous frame cached in the first storage subunit 21. When the image data of the current frame is consistent with the image data of the previous frame, the driving unit 1 may cache the image data of the current frame into the first storage subunit 21 to overwrite the image data of the previous frame cached in the first storage subunit 21, read the cached image data of the previous frame from the second storage subunit 22, convert the read image data of the previous frame into an output signal, and output the output signal to the display panel, such that the display panel displays the image of the previous frame.

According to the embodiment of the present disclosure, when the image data of the current frame is not consistent with the image data of the previous frame, the driving unit 1 may cache the image data of the current frame into the first storage subunit 21 and the second storage subunit 22 to overwrite the image data of the previous frame cached in the first storage subunit 21 and the second storage subunit 22, read the cached image data of the current frame from the second storage subunit 22, convert the read-out image data of the current frame into an output signal, and output the output signal to the display panel, such that the display panel displays the image of the current frame.

According to the embodiment of the present disclosure, the driving unit 1 and storage unit 2 may be connected to each other via a data bus, and transmit data through the data bus.

According to the embodiment of the present disclosure, the original signal of the image of the current frame may be an original signal of an image of a respective frame starting from the second frame. It is necessary for the driving unit 1 to compare the image data of the current frame converted from the original signal of the image of the current frame with image data of the previous frame (obtained by converting the original signal of the image of the previous frame).

According to the embodiment of the present disclosure, when an image of a first frame is displayed, the driving unit 1 may also be configured to receive an original signal of an image of the first frame, convert the original signal of the image of the first frame to image data of the first frame, cache the image data of the first frame into the first storage subunit 21 and the second storage subunit 22, read the cached image data of the first frame from the second storage subunit 22, convert the read image data of the first frame into an output signal, and output the output signal to the display panel, such that the display panel displays the image of the first frame. The original signal of the image of the first frame may be an original signal of the image of the initial frame received by the driving unit 1. Thus, it is not necessary for the driving unit 1 to compare the image data of the first frame converted from the original signal of the image of the first frame.

According to the embodiment of the present disclosure, the driving circuit may be formed as a printed circuit board assembly (PCBA), and the driving unit 1 of the driving circuit may be formed as a field programmable gate array (FPGA). The timing controller chip used in the related art is replaced by the FPGA on the PCBA, and it can significantly lower the cost.

According to the embodiment of the present disclosure, the storage unit 2 may be a random access memory, and may be divided into two storage subunits 21 and 22. The first storage subunit 21 and the second storage subunit 22 may respectively include one or more logic storage banks (Banks). In the following, the description will refer to an example in which the first storage subunit 21 and the second storage subunit 22 each include one logic storage bank. The storage capacity of the storage unit 2 is 16M bytes. The storage capacity of each logic storage bank is 8M bytes. Thus, each logic storage bank may store an image with a resolution of full high definition (FHD), such as an image of a resolution of 1920*1080. The initial access address of the logic storage bank of the first storage subunit 21 may be 0X000000H. The initial access address of the logic storage bank of the second storage subunit 22 may be 0X800000H. However, the present disclosure is not limited thereto, and each logic storage bank may store more images.

According to the embodiment of the present disclosure, the original signal of the image of the frame may be a low voltage differential signal (LVDS). The driving unit 1 may convert the LVDS into a RGB signal as image data of the frame, and the output signal may be Mini-LVDS. However, the present disclosure is not limited thereto, and the original signal of the image of the frame, the image data of the frame and the output signal may be other signals other than the above forms, which will not be set forth herein.

According to the embodiment of the present disclosure, as shown in FIG. 1, the driving unit 1 may include a receiving module 11, a micro control unit 12, a timing control unit 13 and a sending module 14.

The receiving module 11 may receive the original signal of the image of the current frame, convert the original signal of the image of the current frame into image data of the current frame, and output the image data of the current frame to the micro control unit 12. For example, in case where the original signal of the image of the current frame is LVDS and the image data of the current frame is a RGB signal, the receiving module 11 may map the data of the LVDS and convert the LVDS into the RGB signal.

The micro control unit 12 may read out cached image data of the previous frame from the first storage subunit 21, and compare the image data of the current frame and the read-out image data of the previous frame. When the image data of the current frame is consistent with the image data of the previous frame, the micro control unit 12 may cache the image data of the current frame into the first storage subunit 21 to overwrite the image data of the previous frame cached in the first storage subunit 21, read the cached image data of the previous frame from the second storage subunit 22, and output the read image data of the previous frame to the time control unit 13. When the image data of the current frame is not consistent with the image data of the previous frame, the micro control unit 12 may cache the image data of the current frame into the first storage subunit 21 and the second storage subunit 22 to overwrite the image data of the previous frame cached in the first storage subunit 21 and the second storage subunit 22, read the cached image data of the current frame from the second storage subunit 22, and output the read image data of the current frame to the timing control unit 13.

The timing control unit 13 may convert the received image data to an output signal, to generate a timing control signal, and output the output signal and the timing control signal to the sending module 14. The sending module 14 may output the output signal and the timing control signal to the display panel, such that the display panel displays the image of the previous frame or the image of the current frame according to the output signal under the control of the timing control signal.

In addition, the receiving module 11 may further receive the original signal of the frame of the first frame, convert the original signal of the image of the first frame into image data of the first frame, and output the image data of the first frame to the micro control unit 12. The micro control unit 12 may cache the image data of the first frame into the first storage subunit 21 and the second storage subunit 22, read the cached image data of the first frame from the second storage subunit 22, and output the read image data of the first frame to the timing control unit 13. The timing control unit 13 may convert the received image data of the first frame into an output signal, to generate a timing control signal, and output the output signal and the timing control signal to the sending module 14. The sending module 14 may output the output signal and the timing control signal to the display panel, such that the display panel displays the image of the first frame according to the output signal under the control of the timing control signal.

Figure 2:
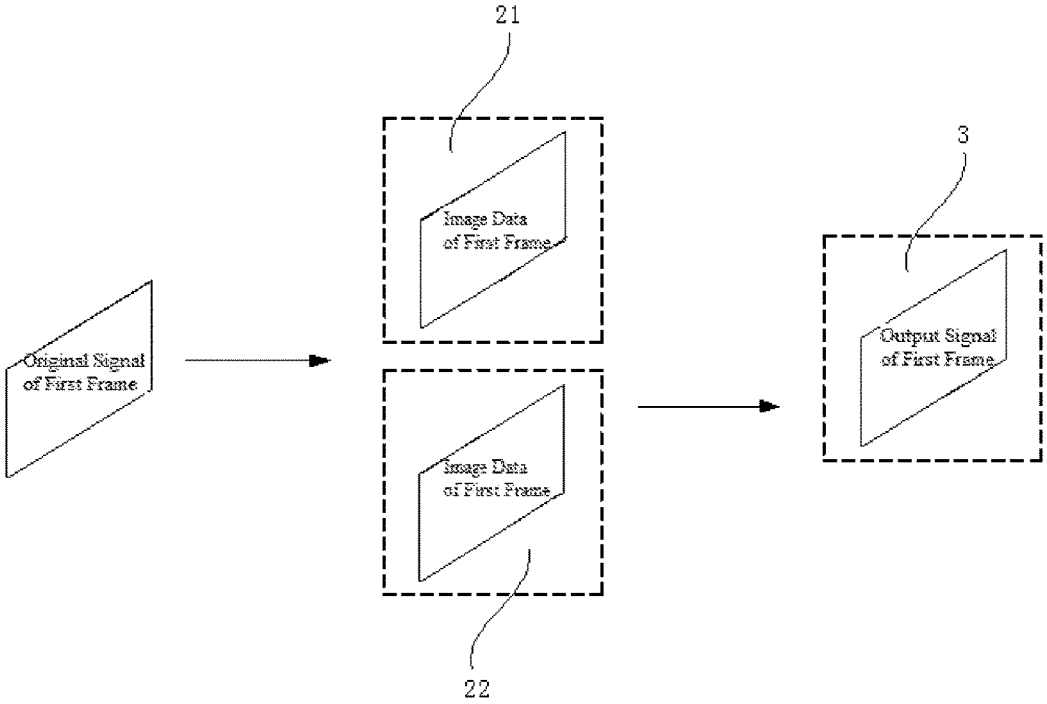
FIGS. 2 to 4 are schematic diagrams for explaining a driving process of a driving circuit according to an embodiment of the present disclosure.
Figure 3:
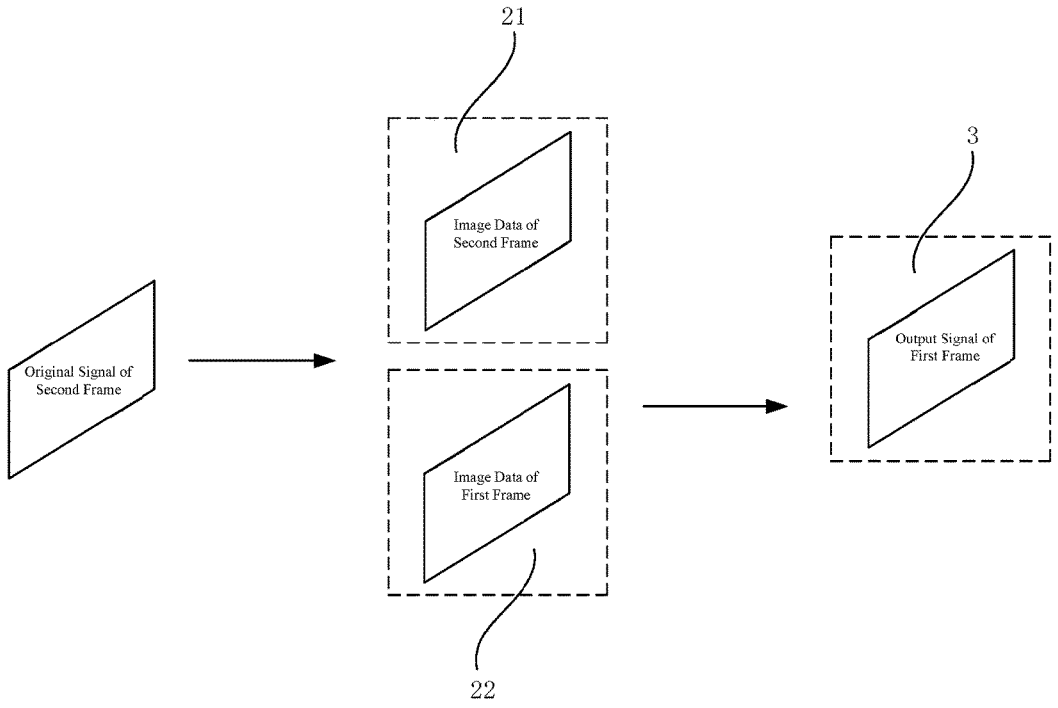
Figure 4:
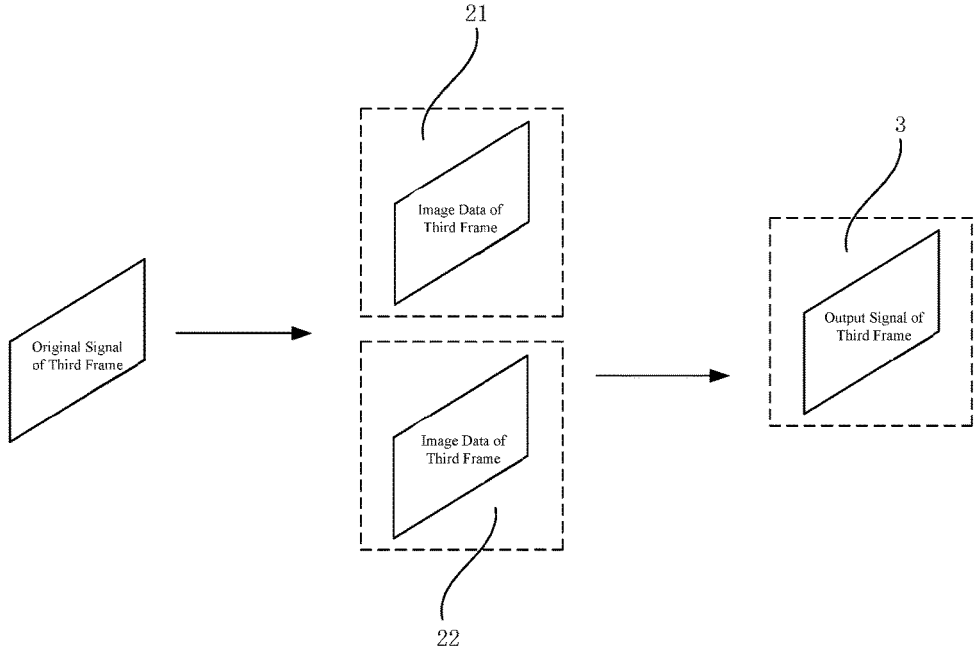

FIGS. 2 to 4 are schematic diagrams for explaining a driving process of a driving circuit according to an embodiment of the present disclosure. The technical solution of the embodiment will be described in detail below with reference to FIGS. 2 to 4.

Referring to FIGS. 1 and 2, the receiving module 11 may receive the original signal of the image of the first frame, convert the original signal of the image of the first frame into image data of the first frame, and output the image data of the first frame to the micro control unit 12. The micro unit 12 may output the image data of the first frame to the first frame to the first storage subunit 21 and the second storage subunit 22 through the data bus, to cache the image data of the first frame into the first frame to the first storage subunit 21 and the second storage subunit 22. Subsequently, the micro control unit 12 may read the cached image data of the first frame from the second storage subunit 22 through the data bus, and output the read image data of the first frame to the timing control unit 13 through the data bus. The timing control unit 13 may convert the received image data of the first frame to an output signal, to generate a timing control signal, and output the output signal and the timing control signal to the sending module 14. The sending module 14 may output the output signal and the timing control signal to the display panel 3, such that the display panel 3 displays the image of the first frame according to the output signal under the control of the timing control signal.

Referring to FIGS. 1 and 3, the receiving module 11 may receive the original signal of the image of the second frame, convert the original signal of the image of the second frame into image data of the second frame, and output the image data of the second frame to the micro control unit 12. The micro control unit 12 may read the cached image data of the first frame from the first storage subunit 21 through the data bus, and compare the image data of the second frame with the read image data of the first frame. When the image data of the second frame is consistent with the image data of the first frame (which indicates a static image condition), the micro control unit 12 may cache the image data of the second frame into the first storage subunit 21 to overwrite the image data of the first frame cached in the first storage subunit 21 though the data bus, read the cached image data of the first frame from the second storage subunit 22 through the data bus, and output the image data of the first frame to the timing control unit 13 through the data bus. The timing control unit 13 may convert the received image data of the first frame into an output signal, to generate a timing control signal, and output the output signal and the timing control signal to the sending module 14. The sending module 14 may output the output signal and the timing control signal to the display panel 3, such that the display panel 3 displays the image of the first frame according to the output signal under the control of the timing control signal.

Referring to FIGS. 1 and 4, the receiving module 11 may receive the original signal of the image of the third frame, convert the original signal of the image of the third frame into image data of the third frame, and output the image data of the third frame to the micro control unit 12. The micro control unit 12 may read the cached image data of the second frame from the first storage subunit 21 through the data bus, and compare the image data of the third frame with the read image data of the second frame. When the image data of the third frame is not consistent with the image data of the second frame (which indicates a dynamic image condition), the micro control unit 12 may output the image data of the third frame to the first storage subunit 21 and the second storage subunit 22 through the data bus, to cache the image data of the third frame into the first storage subunit 21 and the second storage subunit 22, and respectively overwrite the cached image data of the second frame and the cached image data of the second frame. Subsequently, the micro control unit 12 may read the cached image data of the third frame from the second storage subunit 22 through the data bus, and output the read image data of the third frame to the timing control unit 13 through the control unit 13. The control unit 13 may convert the received image data of the third frame into an output signal, to generate a timing control signal, and output the output signal and the timing control signal to the sending module 14. The sending module 14 may output the output signal and the timing control signal to the display panel 3, such that the display panel 3 displays the image of the third frame according to the output signal under the control of the timing control signal. The above process is repeated until the display is finished.

According to the driving circuit of the embodiment of the present disclosure, the image data are respectively cached in the first storage subunit and the second storage subunit. In this way, the signal conversion process is divided and performed, which lowers the probability of outputting an erroneous image signal caused by noise interference during the signal conversion process and thus reduces undesirable influence on the display device.

According to the driving circuit of the embodiment of the present disclosure, when electrostatic discharge testing is performed, especially under the static image condition, the undesirable influence on the display device can be significantly reduced.

Figure 5:
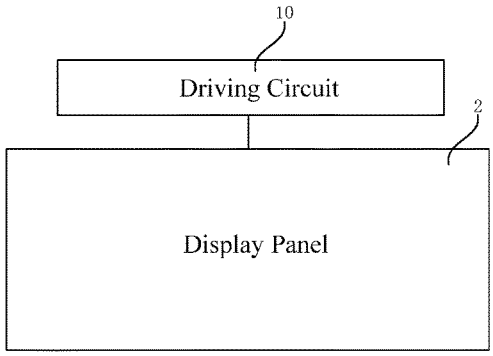
FIG. 5 is a schematic diagram of a display device according to an embodiment of the present disclosure.

FIG. 5 is a schematic diagram of a display device according to an embodiment of the present disclosure.

The display device as shown in FIG. 5 may include a display panel 2 and a driving circuit 10. The driving circuit 10 may employ the driving circuit according to the embodiments of the present disclosure, which will not be described in detail herein.

The driving circuit 10 may be formed as a PCBA, and the driving unit 1 of the driving circuit 10 may be formed as a FPGA. The timing controller chip used in the related art is replaced by the FPGA on the PCBA, and it can significantly lower the cost. In addition, the conversion process is achieved by the FPGA, and it can improve the fault tolerant capability in signal conversion.

The display device according to the embodiments of the present disclosure may be formed as an irregularly shaped display device or a regularly shaped display device, and may be applied to an application of vehicle on-board display. For example, the display device according to the embodiment of the present disclosure may be formed as a liquid crystal display device.

Figure 6:
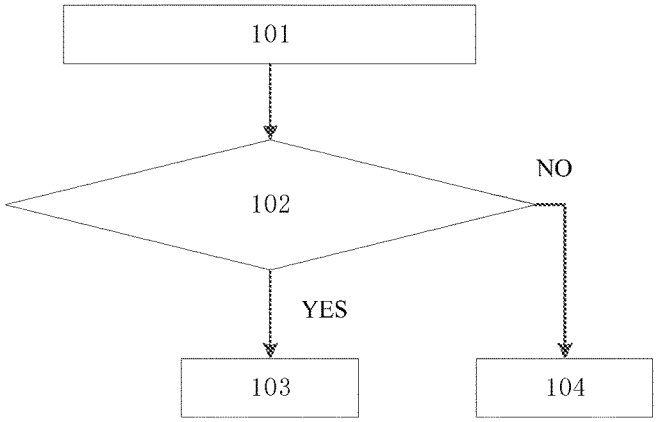
FIG. 6 is a flow chart of a driving method of a driving circuit according to an embodiment of the present disclosure.

FIG. 6 is a flow chart of a driving method of a driving circuit according to an embodiment of the present disclosure.

As shown in FIG. 6, the driving method according to the embodiment may include the following steps:

receiving the original signal of the image of the current frame, and converting the original signal of the image of the current frame into image data of the current frame (step 101);

comparing the image data of the current frame with the image data of the previous frame cached in the storage unit (step 102);

when the image data of the current frame is consistent with the image data of the previous frame ("Yes"), displaying the image of the previous frame (step 103); and when the image data of the current frame is not consistent with the image data of the previous frame ("No"), displaying the image of the current frame (step 104).

Figure 7:
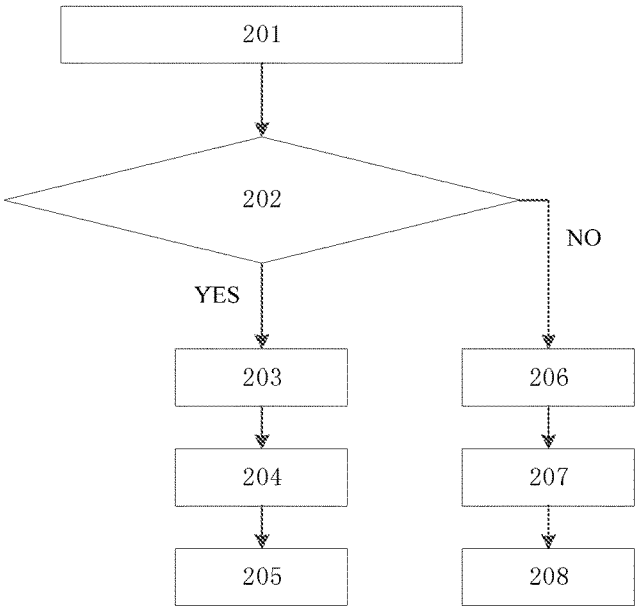
FIG. 7 is a flow chart of a driving method of a driving circuit according to another embodiment of the present disclosure.

FIG. 7 is a flow chart of a driving method of a driving circuit according to another embodiment of the present disclosure.

Referring to FIGS. 1 and 7, the driving circuit according to the embodiment may include a driving unit and a storage unit coupled to the driving unit. The storage unit may include a first storage subunit and a second storage subunit. The driving method according to the embodiment may include the following steps:

receiving the original signal of the frame of the current frame, and converting the original signal of the current frame into image data of the current frame (step 201);

comparing the image data of the current frame with the image data of the previous frame cached in the first storage subunit (step 202);

when the image data of the current frame is consistent with the image data of the previous frame ("Yes"), caching the image data of the current frame into the first storage subunit to overwrite the image data of the previous frame cached in the first storage subunit (step 203), reading the cached image data of the previous frame from the second storage subunit (step 204), converting the image data of the previous frame into an output signal, and outputting the output signal to the display panel, such that the display panel displays the image of the previous frame (step 204);

when the image data of the current frame is not consistent with the image data of the previous frame ("No"), caching the image data of the current frame to the first storage subunit and the second storage subunit to overwrite the image data cached in the first storage subunit and the second storage subunit (step 206), reading the cached image data of the current frame from the second storage subunit (step 207), converting the read image data of the current frame into an output signal, and outputting the output signal to the display panel, such that the display panel displays the image of the current frame (step 208).

Figure 8:
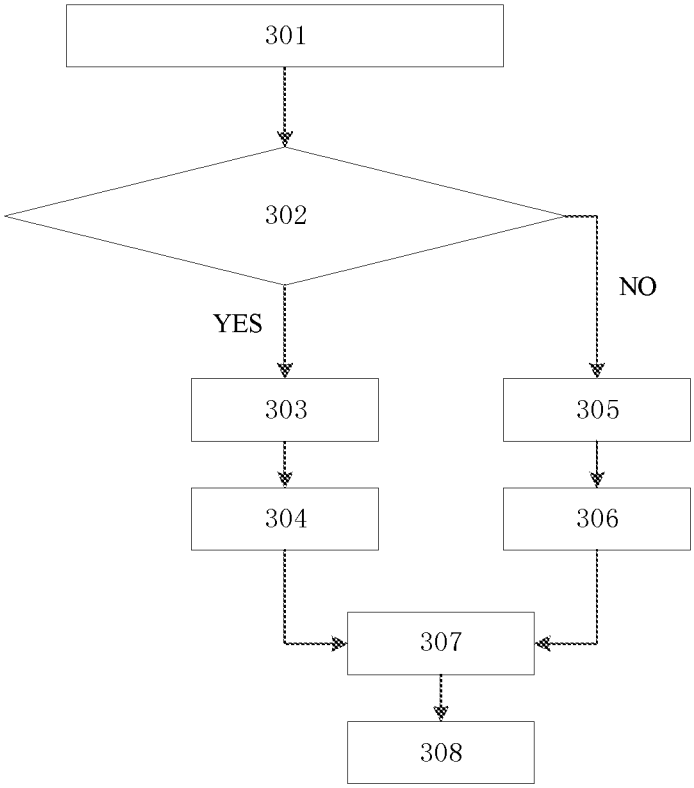
FIG. 8 is a flow chart of a driving method of a driving circuit according to another embodiment of the present disclosure.

FIG. 8 is a flow chart of a driving method of a driving circuit according to another embodiment of the present disclosure.

Referring FIGS. 1 and 8, the driving circuit according to the embodiment may include a driving unit and a storage unit coupled to the driving unit. The driving unit may include a receiving module, a micro control unit, a timing control unit and a sending unit. The storage unit may include a first storage subunit and a second storage subunit. The driving method according to the embodiment may include the following steps:

receiving the original signal of the image of the current frame, converting the original signal of the image of the current frame into image data of the current frame, and outputting the image data of the current frame to the micro control unit, by using the receiving module (step 301);

reading cached image data of the previous frame from the first storage subunit, and comparing the image data of the current frame with the image data of the previous frame, by using the micro control unit (step 302);

when the image data of the current frame is consistent with the image data of the previous frame ("Yes"), caching the image data of the current frame into the first storage subunit to overwrite the image data of the previous frame cached in the first storage subunit (step 303), reading the cached image data of the previous frame from the second storage subunit, and outputting the read image data of the previous frame to the timing control unit, by using the micro control unit (step 304);

when the image data of the current frame is not consistent with the image data of the previous frame ("No"), caching the image data of the current frame into the first storage subunit and the second storage subunit to overwrite the image data of the previous frame cached in the first storage subunit and the second storage subunit (step 305), reading the cached image data of the current frame from the second storage subunit and outputting the read image data of the current frame to the timing control unit, by using the micro control unit (step 306);

converting the received image data into an output signal, to generate a timing control signal, and outputting the output signal and the timing control signal to the sending module, by using the timing control unit (step 307); and outputting the output signal and the timing control signal to the display panel by using the sending module, such that the display panel displays the image of the previous frame or the image of the current frame according to the output signal under the control of the timing control signal (step 308).

It is to be understood that the above embodiments are merely illustrative embodiments for the purpose of illustrating the principles of the present disclosure, but the present disclosure is not limited thereto. It will be apparent to those skilled in the art that various changes and modifications can be made therein without departing from the spirit and essence of the present disclosure, which are also considered to be within the scope of the present disclosure.

What is claimed is:

1. A driving circuit, comprising a driving unit and a storage unit coupled to the driving unit, wherein the storage unit is configured to cache image data, the driving unit is configured to receive an original signal of an image of a current frame, convert the original signal of the image of the current frame into image data of the current frame, and compare the image data of the current frame with image data of a previous frame cached in the storage unit, when the image data of the current frame is consistent with the image data of the previous frame, the driving unit drives a display panel to display an image of the previous frame, when the image data of the current frame is not consistent with the image data of the previous frame, the driving unit drives the display panel to display an image of the current frame, wherein the storage unit comprising a first storage subunit and a second storage subunit, the driving unit compares the image data of the current frame and the image data of the previous frame cached in the first storage subunit, and when the image data of the current frame is consistent with the image data of the previous frame, the driving unit caches the image data of the current frame into the first storage subunit to overwrite the image data cached in the first storage subunit, reads the cached image data of the previous frame from the second storage subunit, converts the read image data of the previous frame into an output signal, and outputs the output signal to the display panel such that the display panel displays the image of the previous frame.

2. The driving circuit of claim 1, wherein when the image data of the current frame is not consistent with the image data of the previous frame, the driving unit caches the image data of the current frame into the first storage subunit and the second storage subunit to overwrite the image data of the previous frame cached in the first storage subunit and the second storage subunit, reads the cached image data of the current frame from the second storage subunit, converts the image data of the current frame into the output signal, and outputs the output signal to the display panel such that the display panel displays the image of the current frame.

3. The driving circuit of claim 2, wherein the driving unit comprises a receiving module, a micro control unit, a timing control unit and a sending module, wherein the receiving module is configured to receive the original signal of the image of the current frame, convert the original signal of the image of the current frame into the image data of the current frame, and output the image data of the current frame to the micro control unit, the micro control unit is configured to read cached image data of the previous frame from the first storage subunit, and compare the image data of the current frame and the image data of the previous frame, when the image data of the current frame is consistent with the image data of the previous frame, the micro control unit caches the image data of the current frame into the first storage subunit to overwrite the image data of the previous frame cached in the first storage subunit, reads the cached image data of the previous frame from the second storage subunit, and outputs the read image data of the previous frame to the timing control unit, when the image data of the current frame is not consistent with the image data of the previous frame, the micro control unit caches the image data of the current frame into the first storage subunit and the second storage subunit to overwrite the image data of the previous frame cached in the first storage subunit and the second storage subunit, and outputs the read image data of the current frame to the timing control unit, the timing control unit is configured to convert the received image data into the output signal, to generate a timing control signal, and output the output signal and the timing control signal to the sending module, and the sending module is configured to output the output signal and the timing control signal to the display panel, such that the display panel displays the image of the previous frame or the image of the current frame according to the output signal under control of the timing control signal.

4. The driving circuit of claim 1, wherein when the original signal of the image of the current frame is a low voltage differential signal, the driving unit is configured to convert the low voltage differential signal into a RGB signal as image data of the current frame, and wherein the output signal is a Mini low voltage differential signal.

5. The driving circuit of claim 1, wherein the first storage subunit and the second storage subunit respectively comprises one or more logic storage banks.

6. The driving circuit of claim 1, wherein the driving unit is further configured to receive an original signal of an image of a first frame, convert the original signal of the image of the first frame into image data of the first frame, cache the image data of the first frame into the first storage subunit and the second storage subunit, read the cached image data of the first frame from the second storage subunit, convert the read image data of the first frame into an output signal, and output the output signal to the display panel, such that the display panel displays the image of the first frame.

7. A display device, comprising a display panel and the driving circuit of claim 1.

8. The display device of claim 7, wherein the driving circuit is a printed circuit board assembly, and the driving unit is a field programmable gate array.

9. A driving method of a driving circuit, the driving circuit comprising a driving unit and a storage unit coupled to the driving unit, wherein the driving method comprises:

receiving an original signal of an image of a current frame, and converting the original signal of the image of the current frame into image data of the current frame;

comparing the image data of the current frame with image data of a previous frame cached in the storage unit;

when the image data of the current frame is consistent with the image data of the previous frame, driving, by the driving unit, a display panel to display an image of the previous frame;

when the image data of the current frame is not consistent with the image data of the previous frame, driving, by the driving unit, the display panel to display an image of the current frame, wherein the storage unit comprising a first storage subunit and a second storage subunit, and the step of comparing the image data of the current frame with image data of a previous frame cached in the storage unit comprises:

comparing the image data of the current frame and the image data of the previous frame cached in the first storage subunit; and when the image data of the current frame is consistent with the image data of the previous frame, caching the image data of the current frame into the first storage subunit to overwrite the image data cached in the first storage subunit, reading the cached image data of the previous frame from the second storage subunit, converting the read image data of the previous frame into an output signal, and outputting the output signal to the display panel such that the display panel displays the image of the previous frame.

10. The driving method of claim 9, wherein:

when the image data of the current frame is not consistent with the image data of the previous frame, caching the image data of the current frame to the first storage subunit and the second storage subunit to overwrite the image data of the previous frame cached in the first storage subunit and the second storage subunit, reading the cached image data of the current frame from the second storage subunit, converting the image data of the current frame to the output signal, and outputting the output signal to the display panel such that the display panel displays the image of the current frame.

11. The driving method of the driving circuit of claim 10, wherein the driving unit comprises a receiving module, a micro control unit, a timing control unit and a sending module, the receiving module receives the original signal of the image of the current frame, converts the original signal of the image of the current frame to the image data of the current frame, and outputs the image data of the current frame to the micro control unit, the micro control unit reads cached image data of the previous frame from the first storage subunit, and compares the image data of the current frame and the image data of the previous frame, when the image data of the current frame is consistent with the image data of the previous frame, the micro control unit caches the image data of the current frame into the first storage subunit to overwrite the image data of the previous frame cached in the first storage subunit, reads the cached image data of the previous frame from the second storage subunit, and outputs the read image data of the previous frame to the timing control unit, when the image data of the current frame is not consistent with the image data of the previous frame, the micro control unit caches the image data of the current frame into the first storage subunit and the second storage subunit to overwrite the image data of the previous frame cached in the first storage subunit and the second storage subunit, and outputs the read image data of the current frame to the timing control unit, the timing control unit converts the received image data into the output signal, to generate a timing control signal, and outputs the output signal and the timing control signal to the sending module, and the sending module outputs the output signal and the timing control signal to the display panel, such that the display panel displays the image of the previous frame or the image of the current frame according to the output signal under control of the timing control signal.

* * * * *